United States Patent [19]

Henderson

[11] Patent Number: 5,016,753

[45] Date of Patent: May 21, 1991

[54] TELESCOPING PACKAGING SYSTEM

[76] Inventor: Donald M. Henderson, 30 Romiga, Palos Park, Ill. 60464

[21] Appl. No.: 386,355

[22] Filed: Jul. 28, 1989

[51] Int. Cl.[5] ..... B65D 5/42

[52] U.S. Cl. ..... 206/459; 116/306; 229/23 BT; 229/101

[58] Field of Search ..... 206/459; 229/23 C, 23 BT, 229/9, 19, 101; 116/306, 307, 283

[56] References Cited

U.S. PATENT DOCUMENTS

| | | | |
|---|---|---|---|
| 803,966 | 11/1905 | Barnes | 229/101 |
| 2,083,868 | 6/1937 | Rottman | 229/101 |
| 2,354,239 | 7/1944 | Williamson | 229/19 |
| 2,675,123 | 4/1954 | Baird | 229/23 BT |
| 2,880,866 | 4/1959 | Van Dyck | 229/23 BT |
| 2,975,631 | 3/1961 | Hansen | 116/306 |
| 3,093,291 | 6/1963 | Brandle . | |
| 3,134,499 | 5/1964 | Johnson . | |
| 3,301,457 | 1/1967 | Millian . | |
| 3,367,487 | 2/1968 | Dwyer, Jr. | 206/459 |
| 3,371,844 | 3/1968 | Perrella . | |
| 3,499,068 | 3/1970 | Brown . | |
| 3,521,748 | 7/1970 | Layne | 229/101 |
| 3,642,193 | 2/1972 | Rada . | |
| 3,670,946 | 6/1972 | Croley | 229/4.5 |
| 3,910,483 | 10/1975 | Ritter | 229/23 BT |
| 3,926,362 | 12/1975 | Beck et al. | 229/23 BT |
| 4,198,921 | 4/1980 | Horton | 116/283 |
| 4,342,416 | 8/1982 | Phillips | 229/23 BT |
| 4,396,144 | 8/1983 | Gutierrez et al. | 229/23 BT |
| 4,440,307 | 4/1984 | Bartels et al. | 220/4 B |
| 4,483,095 | 11/1984 | Webinger | 229/23 BT |
| 4,560,566 | 12/1985 | Roth | 426/399 |
| 4,572,425 | 2/1986 | Russell | 229/23 BT |
| 4,592,163 | 6/1986 | Wilson | 229/23 BT |
| 4,610,358 | 9/1986 | Walter | 206/514 |
| 4,624,382 | 11/1986 | Tontarelli | 220/8 |
| 4,877,119 | 10/1989 | Hosking | 206/459 |

*Primary Examiner*—Gary E. Elkins

*Attorney, Agent, or Firm*—Robert E. Browne; Thomas C. McDonough

[57] ABSTRACT

A telescoping container structure which comprises a plurality of pieces which may be temporarily secured to one another and shipped in a flat form, and a method of manufacturing the same. When assembled, the pieces of the container telescope relative to one another and may be secured to one another at any position to create a container of infinitely variable volume.

33 Claims, 2 Drawing Sheets

TELESCOPING PACKAGING SYSTEM

BACKGROUND OF THE INVENTION

The invention disclosed herein relates to containers, particularly boxes and cartons, for use in packaging various products for shipment. Specifically, this invention concerns packages which telescope, or expand and collapse, to give the container a variable volume depending on the needs of the user. Most boxes and cartons used today have a fixed volume, which often leads to wasted storage space, extra shipping costs, and reduced container strength because the user must employ a container that is too large for volume of the product to be packaged.

To overcome these problems associated with standard containers, various types of telescoping containers have been created to produce variable volumes. This type of container generally consists of two or more portions which may be "telescoped" over one another and fixed in different positions relative to one another before sealing. However, these containers may generally only be fixed at a set number of positions and thus do not have an infinitely variable volume. It would be preferable for the user to be able to use a single container type for a wide range of volumes. In addition, the containers of the prior art had no means of maintaining the telescoping sections relative to one another during filling.

For example, U.S. Pat. No. 3,910,483 to Ritter discloses a container structure formed of two pieces, with the top piece telescoping over the bottom piece to close the container, with the top piece being secured to the bottom piece by adhesive. However, Patent '483 does not disclose a container wherein the top piece may be secured at any location relative to the bottom piece, thereby creating a container of variable volume.

U.S. Pat. No. 4,624,382 to Tontarelli discloses a three-piece plastic container in which each cylindrical piece may be moved relative to the others and secured at set positions to create a variable volume within the container. Patent '382 does not, however, disclose a closed container wherein the telescoping portions may be secured to one another at any position relative to one another, and therefore does not disclose a container with an infinitely variable volume.

U.S. Pat. No. 3,093,291 to Brandle discloses a self-locking telescoping container including a locking means to secure the top piece to the bottom piece. However, this locking means does not allow the pieces to be secured at varying points relative to one another, and thus the Pat. '291 also does not disclose a container of variable volume.

SUMMARY OF THE INVENTION

It is the object of the present invention to provide an improved telescoping container structure of variable volume. One embodiment of the present invention discloses a carton comprising two or more sections which may be moved relative to one another to vary the interior volume of the carton. Before the carton is assembled into its upright position, the sleeves of the various sections are held together temporarily with glue or another fastening means. The carton may be shipped flat in this form, and can be easily assembled in an upright position for use by pushing out the edges of the sleeves. The telescoping sections each contain slits at each corner of one end to form flaps, which are foldable and are used to form the top and bottom panels of the carton after it is assembled.

A further novel feature of this invention is the method of manufacturing the blanks for the sleeves of the telescoping containers, with the improvement being the temporary attachment of the blanks to one another in an offset manner after they have been formed and are in their flat position. Then the opposite ends are permanently attached to form a corner and the blanks folded flat upon themselves. Thus the blanks may be shipped in this intermediate stage and be ready for loading upon receipt. All the user is required to do is to put the sleeve assembly into its upright position by pushing out its sides, and by securing the bottom flaps of the lower sleeve. The fact that the blanks are offset from one another when temporarily attached gives the user an assembled container with a maximum volume, so that the container can be loaded and the volume reduced as required.

In one embodiment of this invention, the flaps of the outer section are folded and secured (e.g. with tape) to form the bottom panel of the container after the sleeves, which are temporarily secured in place using a temporary fastening means, have been pushed up into the upright position. The carton is now ready for loading. This temporary fastening means could include frictional fit between the sleeves, but preferably includes positive means such as tape, glue, or other methods. It is to be noted that the cartons could also be delivered to their final users in a completely unassembled stage, whereby the user would temporarily secure the sleeves to one another after they have been placed in the upright position.

After the carton has been loaded, the flaps of the inner section are closed to form the top of the carton. The temporary fastening means used to connect the sleeves of the telescoping sections are released. This release may be achieved by pressure applied to the top cover in certain instances, or it may be accomplished by other means. After the inner sleeve is released, the top of the box is pushed to slide the inner sleeve down relative to the outer sleeve and thus create the desired amount of volume in the box. The final position of the top sleeve with respect to the bottom sleeve may be at any position where the two sleeves are in contact, and is not limited to being in the position where the smaller sleeve is fully inserted into the larger sleeve.

After the sleeves are placed in the final position they are permanently fastened to one another using a second fastening means. This second fastening means could include a water or solvent activated adhesive system, which is activated by applying liquid around the edges of the sections or through strategically located holes in the sleeves. It could also include systems using hot melt glue or tape applied at the edges of the sections or through holes on the sleeves. Other possible fastening means include stapling, banding, frictional connection, or the use of additional flaps on the outer sleeve to allow the use of a contact adhesive. These additional flaps could be foldable at various points, thus allowing the user to secure them to the top or sides of the inner sleeve, depending upon the final volume of the container. This list of fastening means is not inclusive, and other possible means may be used within the spirit and scope of this invention.

Thus the user of this invention has a container which may be quickly adapted to carry loads of different volumes, while minimizing the amount of space wasted by empty packaging. This is important because wasted space in a container makes packaging more costly and it reduces the strength of the box or container. A further feature of this invention is a container which may be shipped to its final users in its knocked-down format with the sleeves temporarily secured to one another. Thus the container may be quickly and easily placed into its loading position.

Another feature of the present invention is a means to measure the volume of the goods placed inside the container. This means may comprise a calibration scale placed along the inside sleeve, with the reading of the final volume taken at the top of the outer sleeve or through a hole placed in the outer sleeve. The user may wish to load only a given volume, and this feature of the invention allows the user to check the final volume and adjust it if necessary.

Some users may only package a certain number of products, each with a different volume. This method of determining the interior volume allows such a user to quickly determine the contents of the package prior to labeling, without the need for opening the package. A package used for this purpose could have product identification tags located at various points along the inner sleeve in place of the volume calibration scale.

The foregoing description of the invention has been limited to an embodiment using only two sleeves. It is to be understood that the present invention is not to be read as limited in such a way, as the invention could be used with more than two sleeves. As an example of such an embodiment, the outer sleeve would form the bottom, and the innermost sleeve would form the top, and intermediate sleeves would be placed between, and would slide relative to, the outermost sleeve and the innermost sleeve. The sleeves could be secured to one another, both temporarily and permanently, in a manner similar to that described above.

In addition, the invention is not to be read as limited to having the largest sleeve serve as the bottom of the container and the smallest sleeve serve as the top. This invention also encompasses a container with the larger sleeve serving as the top of the container. It is also to be understood that this invention may be used for containers of various sizes and shapes, including, but not limited to round, square, or rectangular shapes.

DETAILED DESCRIPTION OF THE DRAWINGS

Figure 1:
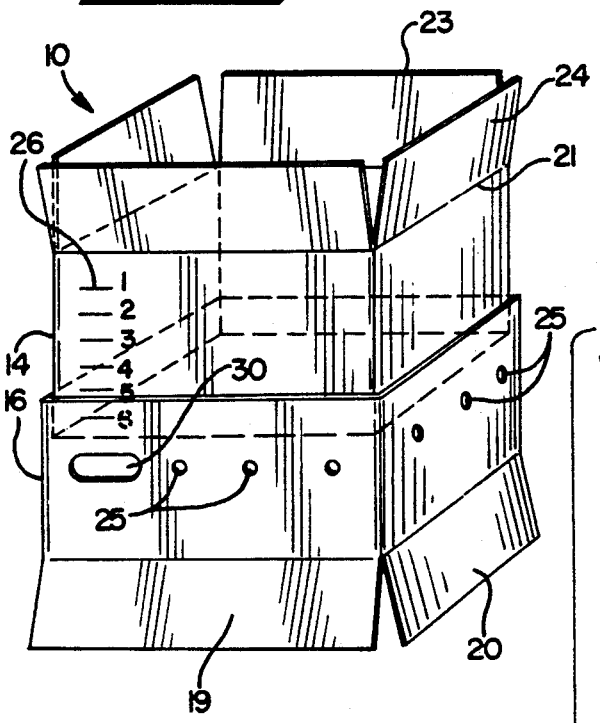
FIG. 1 is a perspective drawing of the device as it would be prior to loading, with the inner sleeve partially inserted into the outer sleeve, and with the end flaps unfolded to show them as they would be prior to insertion of the inner sleeve into the outer sleeve.
Figure 2:
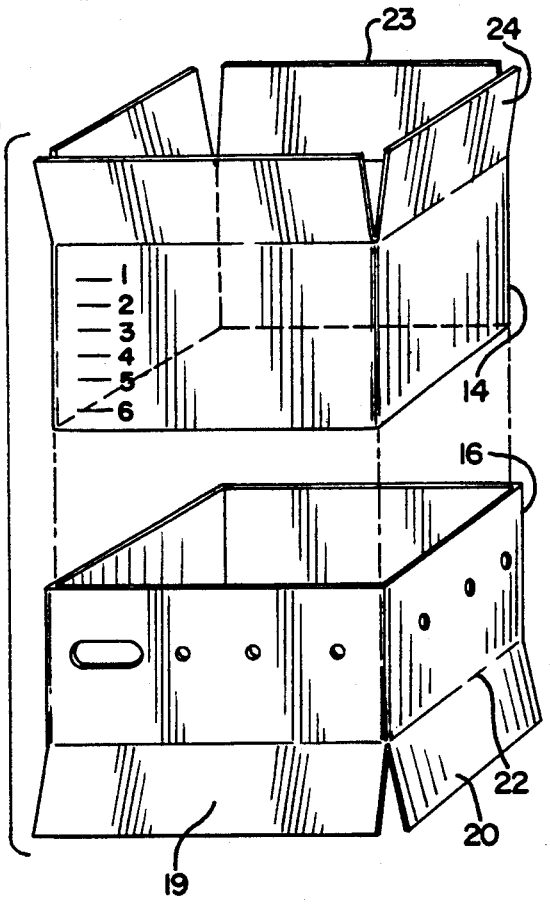
FIG. 2 is an exploded perspective view showing the relationship between the inner and outer sleeves.
Figure 3:
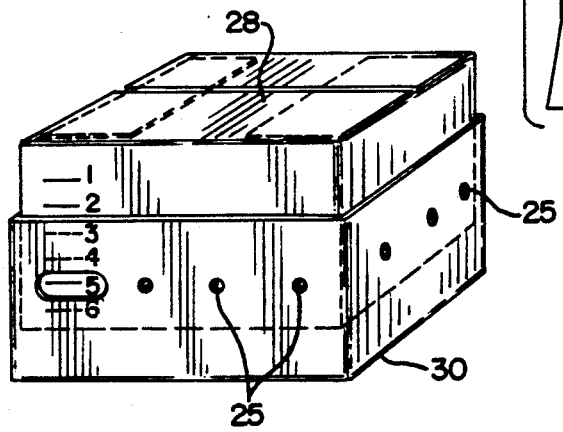
FIG. 3 is a perspective view of the packaging system in a final position.

Packaging system 10 is shown in these Figures as consisting of a rectangular or square box; however, other shapes could be used within the spirit of these inventions. The following descriptions are intended to describe a preferred embodiment of the disclosed invention, and are not intended to limit the scope of the invention in any manner. As can be seen in FIGS. 1–3, packaging system 10 consists of inner sleeve 14 and outer sleeve 16. Inner sleeve 14 is shown as containing side flaps 23 and end flaps 24 integrally formed with the top of sleeve 14. Flaps 23 and 24 are folded at creases 21 to form a closed top 28, as shown in FIG. 3. Inner sleeve 14 is sized appropriately to slidably fit within outer sleeve 16. Outer sleeve 16 includes end flaps 20 and side flaps 19 integrally formed at the bottom thereof, and which fold at creases 22 to form the bottom 30 of the packaging system. Additional telescoping sleeves could be used to increase the volume of the container.

Figure 4:
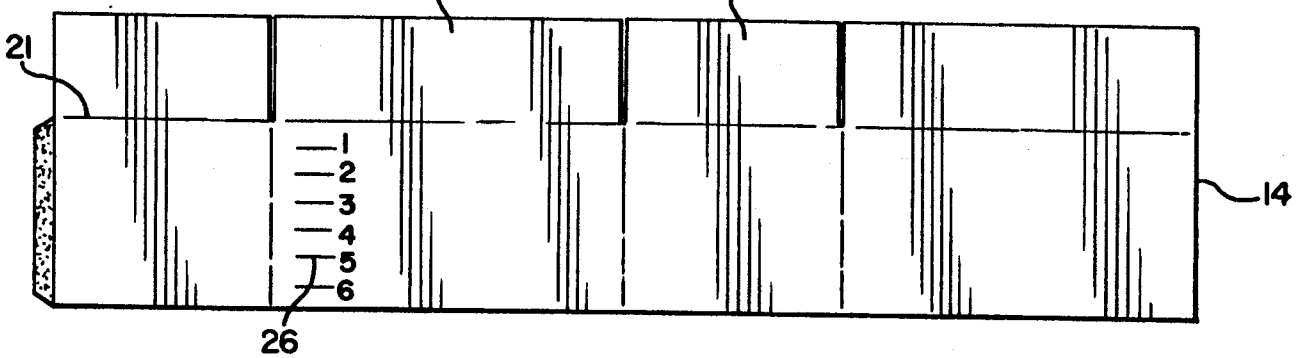
FIG. 4 is a plan view showing the blank from which the inner sleeve is formed.
Figure 5:
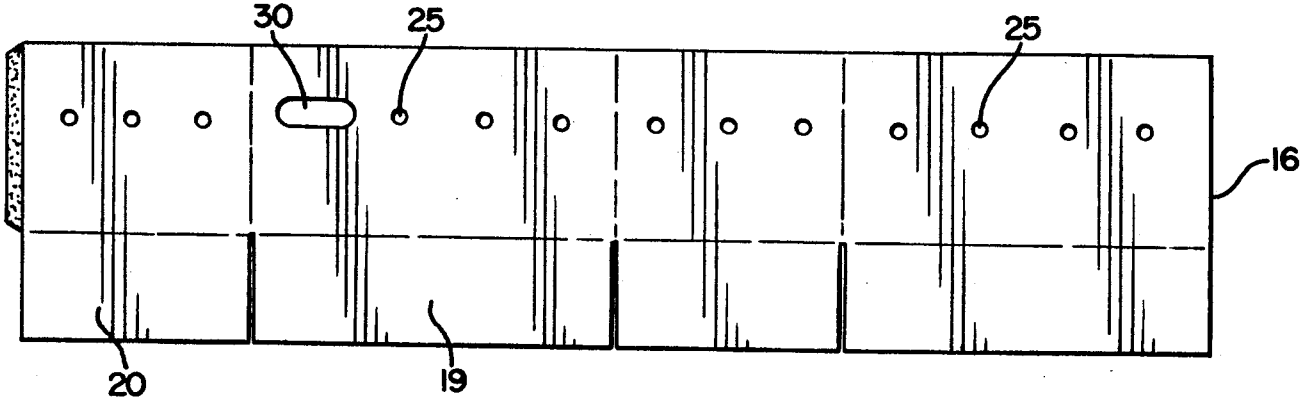
FIG. 5 is a plan view showing the blank from which the outer sleeve is formed.

FIGS. 4 and 5 show blanks from which the sleeves 14 and 16 may be formed. In a preferred embodiment, these two blanks are temporarily glued or otherwise secured together in the flat form, with one blank offset from the other blank. Opposite corners of each blank may be then glued to one another to form endless sleeves 14 and 16. These sleeves are then folded at their corners so as to again lie flat for shipping. The user may then quickly place the glued-together blank into their usual configuration as shown in FIG. 1 by pushing on the ends or sides of the collapsed sleeves. Bottom flaps 19 and 20 are then closed and sealed and the carton is ready to be loaded with items. When the appropriate number of items have been loaded, top flaps 23 and 24 are folded appropriately and secured to form a top to the container. Inner sleeve 14 is then released from its temporary position and is pushed down into outer sleeve 16 until the desired volume is achieved.

In one embodiment of this invention, the temporary securing means may consist of glue which is inserted between the inner sleeve and the outer sleeve. The glue would be strong enough to hold the sleeves together in the temporary position, but weak enough so that the sleeves could be easily released from this position without damage to the sleeves themselves. For example, the user could move the sleeves from this temporary position merely by pushing on the closed top of the box. Other temporary securing means including, but not limited to, tape, friction, or banding could also be used.

Inner sleeve 14 may include a volume scale 26 printed thereon. When the container is in the temporary position, its final position as shown in FIG. 3, or any intermediate position, the volume of the container may be read from this scale through viewing hole 30 formed into outer sleeve 16. Other information or codes could be printed on the inner sleeve in place of this volume scale, depending upon the needs of the users.

When the container 10 is at its final position, it may be permanently secured there by variety of means. One method possible with the embodiment shown in these drawings is the insertion of glue through glue holes 25 formed into outer sleeve 16, thereby binding the sleeves together. As discussed above, other means may be used for this permanent securing.

It is understood that the foregoing description is intended to describe certain embodiments of the present invention, and is not intended to limit it in any way. This invention is to be read as limited by its claims only.

I claim:

1. A packaging system for producing a container of variable volume comprising:

an inner sleeve and an outer sleeve, said inner sleeve and said outer sleeve formed so that said inner sleeve slidably fits within said outer sleeve to form a closable container;

means for temporarily securing said inner sleeve at a first position in relation to said outer sleeve, said first position creating a container having a first volume; and means for permanently securing and holding said inner sleeve in a second position in relation to said outer sleeve, said second position creating a container having a second volume.

2. A packaging system in accordance with claim 1, wherein said second volume is less than said first volume.

3. A packaging system in accordance with claim 1, wherein said means for permanently securing said inner sleeve to said outer sleeve is operable on said inner sleeve and said outer sleeve at any position of said inner sleeve relative to said outer sleeve.

4. A packaging system in accordance with claim 1, wherein said inner sleeve includes a first set of flaps integrally formed at one end, said first set of flaps being foldable to form a first end of the closable container; and said outer sleeve includes a second set of flaps integrally formed at one end, said second set of flaps being foldable to form a second end of said closable container.

5. A packaging system in accordance with claim 1, wherein said means for temporarily securing said inner sleeve and said outer sleeve consists of the frictional fit between said inner sleeve and said outer sleeve.

6. A packaging system in accordance with claim 1, wherein said means for temporarily securing said inner sleeve and said outer sleeve consists of glue inserted between said inner sleeve and said outer sleeve.

7. A packaging system in accordance with claim 1, wherein said means for temporarily securing said inner sleeve and said outer sleeve consists of tape used to connect said inner sleeve and said outer sleeve.

8. A packaging system in accordance with claim 1, wherein said means for permanently securing said inner sleeve and said outer sleeve consists of glue inserted between said inner sleeve and said outer sleeve.

9. A packaging system in accordance with claim 1, wherein said means for permanently securing said inner sleeve and said outer sleeve consists of tape used to connect said inner sleeve and said outer sleeve.

10. A packaging system in accordance with claim 1, wherein said inner sleeve and said outer sleeve are formed in a generally rectangular shape.

11. A packaging system in accordance with claim 1, wherein said closable container includes a means for determining the volume of said closable container, said means consisting of said inner sleeve having a scale printed thereon and said outer sleeve having an opening formed therein at a position such that said scale can be seen through said opening when said inner sleeve is in contact with said outer sleeve in a telescoping fashion.

12. A packaging system for producing a container of variable volume comprising:

a plurality of sleeves capable of being inserted within one another in a telescoping fashion, each of said sleeves having an interior surface and an exterior surface, said sleeves being sized appropriately such that a said exterior surface of one sleeve may be fit within and slidably contact the said interior surface of a second sleeve, and further sleeves may be assembled accordingly as desired;

means for temporarily securing said sleeves to one another in a first position, said first position creating a container having a first volume; and means for permanently securing said sleeves to one another in a second position, said second position creating a container having a second volume.

13. A packaging system in accordance with claim 12, wherein said second volume is less than said first volume.

14. A packaging system in accordance with claim 12, wherein said means for permanently securing said sleeves to one another is operable on said sleeves at any position of one said sleeves relative to another said sleeves to form a container having any desired volume.

15. A packaging system in accordance with claim 12, wherein one of said sleeves includes a first set of flaps integrally formed at one end thereof, said first set of flaps being foldable to form a first end of the closable container; and a second of said sleeves includes a second set of flaps integrally formed at one end thereof, said second set of flaps being foldable to form a second end of said closable container.

16. A packaging system in accordance with claim 12, wherein said means for temporarily securing said sleeves consists of the frictional fit between said sleeves.

17. A packaging system in accordance with claim 12, wherein said means for temporarily securing said sleeves consists of glue inserted between said sleeves.

18. A packaging system in accordance with claim 12, wherein said means for temporarily securing said sleeves consists of tape used to connect said sleeves.

19. A packaging system in accordance with claim 12, wherein said means for permanently securing said sleeves consists of glue inserted between said sleeves.

20. A packaging system in accordance with claim 12, wherein said means for permanently securing said sleeves consists of tape used to connect said sleeves.

21. A packaging system in accordance with claim 12, wherein said sleeves are formed in a generally rectangular shape.

22. A packaging system in accordance with claim 12, wherein said closable container includes a means for determining said first volume and said second volume, said means comprising one or more of said sleeves having a scale printed thereon and another of said sleeves having an opening formed therein in a position relative to said scale so that said scale can be seen through said opening when sleeves are in telescoping contact with one another.

23. A packaging container, including a plurality of sleeves capable of being inserted within one another in a telescoping fashion, each said sleeve having an interior surface and an exterior surface, and each said sleeve being sized appropriately such that a said exterior surface of one sleeve may be fit within and slidably contact a said interior surface of a second sleeve, and further sleeves may be assembled accordingly as desired; wherein the improvement comprises:

means for temporarily securing said sleeves to one another in a first position, said first position creating a container having a first volume; and means for permanently securing said sleeves to one another in a second position, said second position creating a container having a second volume.

24. A packaging system in accordance with claim 23, wherein said second volume is less than said first volume.

25. A packaging system in accordance with claim 23, wherein said means for permanently securing said sleeves to one another is operable on said sleeves at any position of one said sleeve relative to another said sleeve to form a container having any desired volume.

26. A packaging system in accordance with claim 23, wherein one of said sleeves includes a first set of flaps integrally formed at one end thereof, said first set of flaps being foldable to form a first end of the closable container; and a second of said sleeves includes a second set of flaps integrally formed at one end thereof, said second set of flaps being foldable to form a second end of said closable container.

27. A packaging system in accordance with claim 23, wherein said means for temporarily securing said sleeves consists of the frictional fit between said sleeves.

28. A packaging system in accordance with claim 23, wherein said means for temporarily securing said sleeves consists of glue inserted between said sleeves.

29. A packaging system in accordance with claim 23, wherein said means for temporarily securing said sleeves consists of tape used to connect said sleeves.

30. A packaging system in accordance with claim 23, wherein said means for permanently securing said sleeves consists of glue inserted between said sleeves.

31. A packaging system in accordance with claim 23, wherein said means for permanently securing said sleeves consists of tape used to connect said sleeves.

32. A packaging system in accordance with claim 23, wherein said sleeves are formed in a generally rectangular shape.

33. A packaging system in accordance with claim 23, wherein said closable container includes a means for determining the volume of said closable container, said means comprising at least one of said sleeves having a scale printed thereon and another of said sleeves having an opening formed therein in a position such that said scale can be seen through said opening when said sleeves are in a telescoping position relative to one another.

* * * * *